US006398443B1

(12) United States Patent
Barela

(10) Patent No.: US 6,398,443 B1
(45) Date of Patent: Jun. 4, 2002

(54) BATHING GLOVE

(76) Inventor: Joseph L. Barela, 6573 Elder St., Los Angeles, CA (US) 90042

( * ) Notice: Subject to any disclaimer, the term of this patent is extended or adjusted under 35 U.S.C. 154(b) by 0 days.

(21) Appl. No.: 09/871,848

(22) Filed: Jun. 1, 2001

(51) Int. Cl.[7] ..... A47K 7/02
(52) U.S. Cl. ..... 401/201; 401/7
(58) Field of Search ..... 401/201, 7, 8, 401/6; 15/118; 2/159, 161.6, 161.7

(56) References Cited

U.S. PATENT DOCUMENTS 1,209,763 A * 12/1916 Rosengren ..... 401/7
1,990,030 A * 2/1935 Jaffe ..... 401/7
2,265,329 A * 12/1941 Wachs ..... 401/7
3,711,889 A 1/1973 Jennings
3,885,249 A 5/1975 De Brabander
4,183,100 A 1/1980 De Marco
4,825,499 A 5/1989 Baptiste
D349,373 S 8/1994 Marley
5,673,435 A 10/1997 Gebhard
6,098,234 A * 8/2000 Jackson, Jr. ..... 15/118

* cited by examiner

*Primary Examiner*—David J. Walczak

(57) ABSTRACT

A bathing glove for more efficiently and comfortably washing a body. The bathing glove includes a body member designed for receiving a hand of a user with a pocket portion. The pocket portion has an aperture designed for holding a bar of soap. The pocket portion is designed for positioning the bar of soap adjacent the palm of the hand.

10 Claims, 2 Drawing Sheets

BATHING GLOVE

BACKGROUND OF THE INVENTION

1. Field of the Invention

The present invention relates to bath gloves and more particularly pertains to a new bathing glove for more efficiently and comfortably washing a body.

2. Description of the Prior Art

The use of bath gloves is known in the prior art. More specifically, bath gloves heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 4,825,499; U.S. Pat. No. 5,673,435; U.S. Pat. No. 3,885,249; U.S. Pat. No. 3,711,889; U.S. Pat. No. 4,183,100; and U.S. Pat. No. Des. 349,373.

While these devices fulfill their respective, particular objectives and requirements, the aforementioned patents do not disclose a new bathing glove. The inventive device includes a body member designed for receiving a hand of a user. The body member includes a pocket portion. The pocket portion has an aperture designed for holding a bar of soap. The pocket portion is designed for positioning the bar of soap adjacent the palm of the hand.

In these respects, the bathing glove according to the present invention substantially departs from the conventional concepts and designs of the prior art, and in so doing provides an apparatus primarily developed for the purpose of more efficiently and comfortably washing a body.

SUMMARY OF THE INVENTION

In view of the foregoing disadvantages inherent in the known types of bath gloves now present in the prior art, the present invention provides a new bathing glove construction wherein the same can be utilized for more efficiently and comfortably washing a body.

The general purpose of the present invention, which will be described subsequently in greater detail, is to provide a new bathing glove apparatus and method which has many of the advantages of the bath gloves mentioned heretofore and many novel features that result in a new bathing glove which is not anticipated, rendered obvious, suggested, or even implied by any of the prior art bath gloves, either alone or in any combination thereof.

To attain this, the present invention generally comprises a body member designed for receiving a hand of a user with a pocket portion. The pocket portion has an aperture designed for holding a bar of soap. The pocket portion is designed for positioning the bar of soap adjacent the palm of the hand, a body member designed for receiving a hand of a user with a pocket portion. The pocket portion has an aperture designed for holding a bar of soap. The pocket portion is designed for positioning the bar of soap adjacent the palm of the hand.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new bathing glove apparatus and method which has many of the advantages of the bath gloves mentioned heretofore and many novel features that result in a new bathing glove which is not anticipated, rendered obvious, suggested, or even implied by any of the prior art bath gloves, either alone or in any combination thereof.

It is another object of the present invention to provide a new bathing glove which may be easily and efficiently manufactured and marketed.

It is a further object of the present invention to provide a new bathing glove which is of a durable and reliable construction.

An even further object of the present invention is to provide a new bathing glove which is susceptible of a low cost of manufacture with regard to both materials and labor, and which accordingly is then susceptible of low prices of sale to the consuming public, thereby making such bathing glove economically available to the buying public.

Still yet another object of the present invention is to provide a new bathing glove which provides in the apparatuses and methods of the prior art some of the advantages thereof, while simultaneously overcoming some of the disadvantages normally associated therewith.

Still another object of the present invention is to provide a new bathing glove for more efficiently and comfortably washing a body.

Yet another object of the present invention is to provide a new bathing glove which includes a body member designed for receiving a hand of a user with a pocket portion. The pocket portion has an aperture designed for holding a bar of soap. The pocket portion is designed for positioning the bar of soap adjacent the palm of the hand.

Still yet another object of the present invention is to provide a new bathing glove that allows the user to soap his body without worrying about dropping the soap bar.

Even still another object of the present invention is to provide a new bathing glove that more thoroughly cleans the body by means of the textured surface of the glove.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
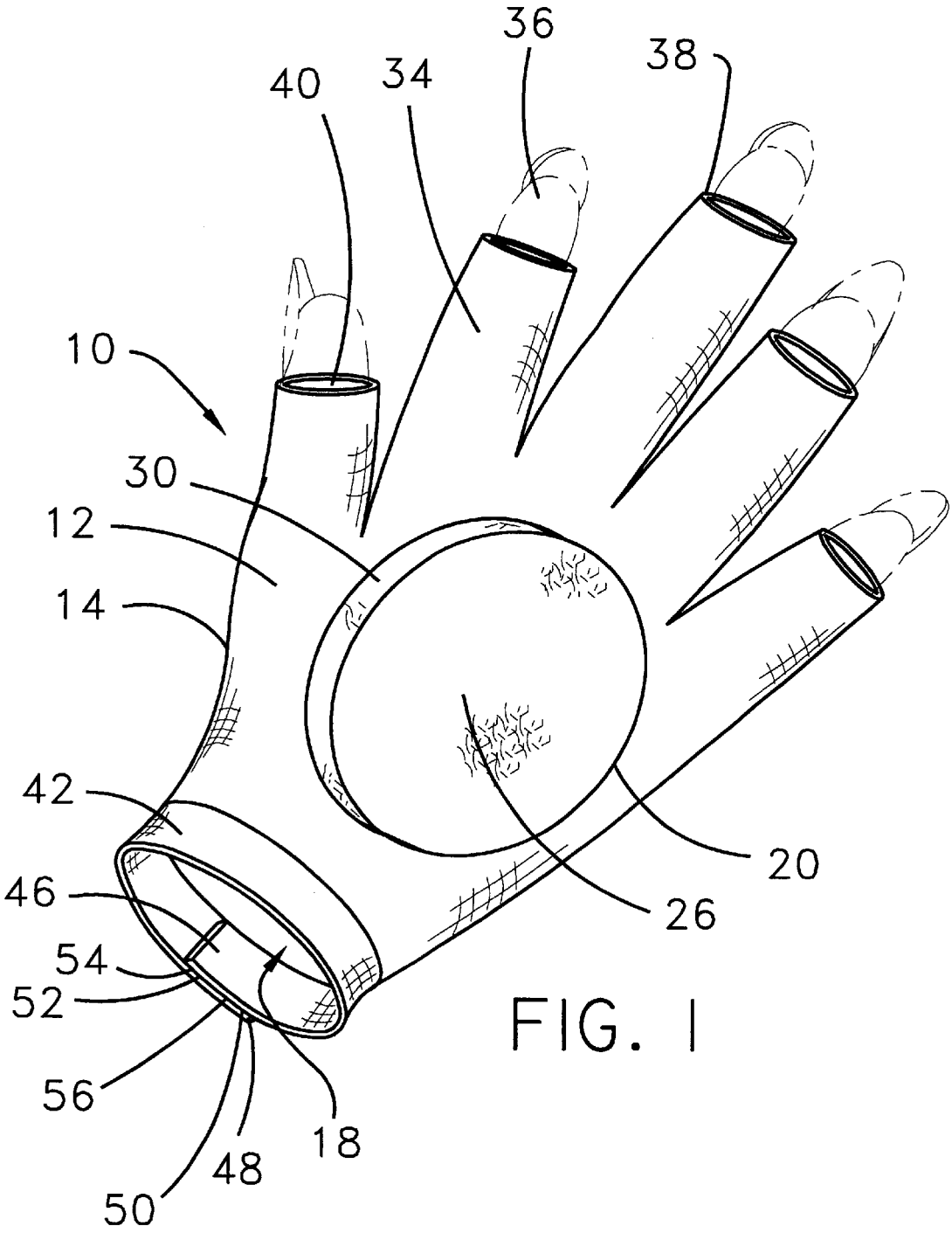
FIG. 1 is a schematic perspective view of a new bathing glove according to the present invention.
Figure 2:
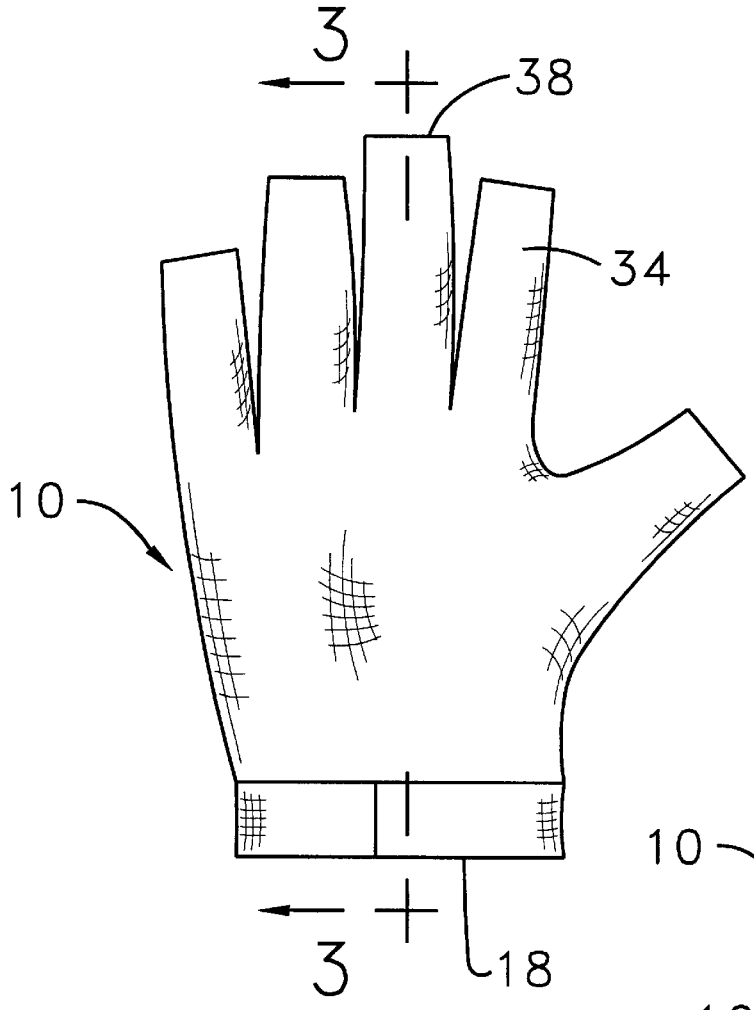
FIG. 2 is a schematic top view of the present invention.
Figure 3:
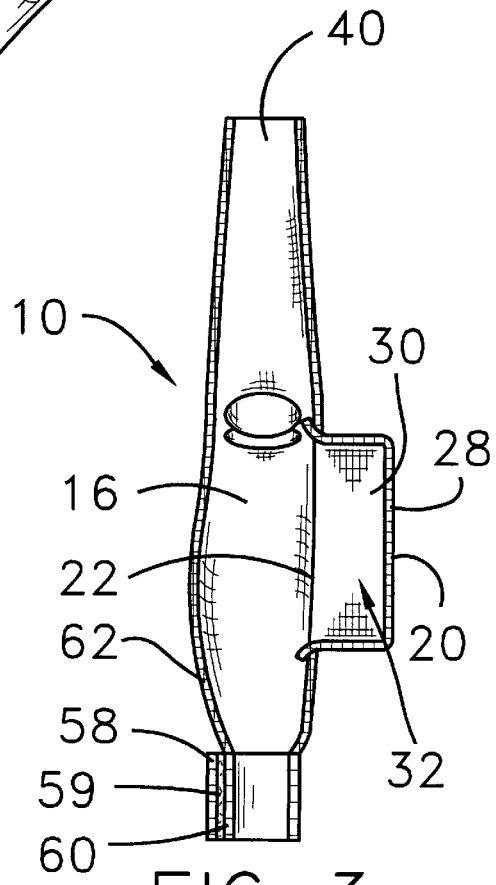
FIG. 3 is a schematic side view of the present invention.

With reference now to the drawings, and in particular to FIGS. 1 through 3 thereof, a new bathing glove embodying the principles and concepts of the present invention and generally designated by the reference numeral 10 will be described.

As best illustrated in FIGS. 1 through 3, the bathing glove 10 generally comprises a body member 12 that includes a perimeter wall 14 defining an interior space 16. The body member 12 is designed for receiving a hand of the user into the interior space 16 through an open end 18 of the body member 12.

A pocket portion 20 is coupled to an aperture 22 in the perimeter wall 14 of the body member 12. The pocket portion 20 is designed for holding a bar of soap when the user is bathing. The pocket portion 20 is proximate a palm portion 26 of the body member 12 such that the pocket portion 20 is designed for positioning the bar of soap adjacent a palm of the hand for the user to apply pressure on the bar of soap when the hand of the user is positioned in the body member 12 while bathing.

The pocket portion 20 includes a bottom wall 28 and a peripheral wall 30, both defining a cavity 32. The cavity 32 is designed for holding the bar of soap such that the soap is insertable into the cavity 32 of the pocket portion 20 through the interior space 16 of the body member 12.

In an embodiment, the pocket portion 20 comprises a porous material for permitting water to flow over the bar of soap when the bar of soap is positioned in the pocket portion 20. The porous material of the pocket portion 20 is designed for facilitating scrubbing and exfoliating of the skin of the user.

The body member 12 includes a plurality of digit sleeves 34. The digit sleeves 34 are positioned opposite the open end 18 of the body member 12. Each of the digit sleeves 34 is designed for receiving one of the digits 36 of the hand of the user when the hand of the user is positioned in the interior space 16 of the body member 12.

Each of the digit sleeves 34 includes a free end 38 positioned opposite the open end 18. The free end 38 of each of the digit sleeves 34 includes an orifice 40 for permitting a portion of a respective one of the digits 36 to extend from the body member 12.

A strap 42 is coupled to the body member 12 adjacent the open end 18 of the body member 12. The strap 42 is designed for extending around a wrist of the user for securing the body member 12 to the wrist of the user when the hand of the user is positioned in the interior space 16 of the body member 12.

The strap 42 includes a first end 46 and second end 48. The first end 46 includes a first fastener portion 50 coupled to an exterior surface 52 of the strap 42.

The second end 48 includes a second fastener portion 54 coupled to an interior surface 56 of the strap 42.

The first fastener portion 50 is for releasably coupling to the second fastener portion 54 such that the second end 48 of the strap 42 extends over the first end 46 of the strap 42 for adjustably setting a radius of the strap 42 when the first end 46 is coupled to the second end 48. The fastener portions are designed for adjustably accommodating a variety of wrist sizes.

The first fastener portion 50 comprises a first portion 58 of hook and loop fastener 59. The second fastener portion 54 comprises a second portion 60 of hook and loop fastener 59. The first portion 58 of hook and loop fastener 59 is complimentary to the second portion 60 of hook and loop fastener 59 such that the first portion 58 of hook and loop fastener 59 is releasably couplable to the second portion 60 of hook and loop fastener 59.

The first and second ends 46, 48 of the strap 42 are positioned adjacent a back portion 62 of the body member 12 such that the first end 46 and the second end 48 of the strap 42 are designed for being positioned adjacent a back of the wrist. This allows adjusting of the radius of the strap 42 when the hand of the user is positioned in the interior space 16 of the body member 12.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A bathing glove for aiding in the cleaning of a body of a user while bathing, the bathing glove:

a body member having a perimeter wall defining an interior space, said body member being adapted for receiving a hand of the user into said interior space of said body member through an open end of said body member; and a pocket portion being coupled to an aperture in said perimeter wall of said body member, said pocket portion being adapted for holding a bar of soap when the user is bathing, said pocket portion being positioned proximate a palm portion of said body member such that said pocket portion is adapted for positioning the bar of soap adjacent a palm of the hand for the user to apply pressure on the bar of soap when the hand of the user is positioned in said body member while bathing;

wherein said pocket portion defines a cavity, said cavity being open to said interior space of said body member such that the bar of soap is insertable into said cavity of said pocket portion through said interior space when the hand of the user removed from said interior space;

wherein said pocket portion includes a bottom wall and a peripheral wall, the peripheral wall of said pocket portion extending substantially perpendicular to the palm portion of said body member such that said pocket portion protrudes outwardly from an outer surface of said body member.

2. The bathing glove as set forth in claim 1, wherein the bottom wall of said pocket portion extends substantially perpendicular to the peripheral wall of said pocket portion, the bottom wall extending substantially parallel to the palm portion of said body member.

3. The bathing glove as set forth in claim 1, wherein said pocket portion comprises a porous material, said porous material being adapted for permitting water to flow over the bar of soap when the bar of soap is positioned in the pocket portion, said porous material of said pocket portion being adapted for facilitating scrubbing and exfoliating of skin of the user.

4. The bathing glove as set forth in claim 1, wherein said body member has a plurality of digit sleeves, said digit sleeves being positioned opposite said open end of said body member, each of said digit sleeves being adapted for receiving one of the digits of the hand of the user when the hand of the user is positioned in said interior space of said body member.

5. The bathing glove as set forth in claim 4, wherein each of said digit sleeves has an free end positioned opposite said body member, said free end of each of said digit sleeves having an orifice for permitting a portion of a respective one of the digits to extend from said body member.

6. The bathing glove as set forth in claim 1, further comprising:

a strap being coupled to said body member adjacent said open end of said body member, said strap being adapted for extending around a wrist of the user for securing said body member to the wrist of the user when the hand of the user is positioned in said interior space of said body member.

7. The bathing glove as set forth in claim 6, wherein said strap member has a first end and second end, said first end having a first fastener portion coupled to an exterior surface of said strap, said second end having a second fastener portion coupled to an interior surface of said strap, said first fastener portion being for releasably coupling to said second fastener portion such that said second end of said strap extends over said first end of said strap for adjustably setting a radius of said strap when said first end is coupled to said second end, said strap being adapted for adjustably accommodating a variety of wrist sizes.

8. The bathing glove as set forth in claim 7, wherein said first fastener portion comprises a first portion of hook and loop fastener, said second fastener portion comprises a second portion of hook and loop fastener, said first portion of hook and loop fastener being complimentary to said second portion of hook and loop fastener such that said first portion of hook and loop fastener is releasably couplable to said second portion of hook and loop fastener.

9. The bathing glove as set forth in claim 7, wherein said first end and said second end of said strap are positioned adjacent a back portion of said body member such that said first end and said second end of said strap are adapted for being positioned adjacent a back of the wrist for facilitating adjusting said radius of said strap when the hand of the user is positioned in said interior space of said body member.

10. A bathing glove for aiding in the cleaning of a body of a user while bathing, the bathing glove comprising:

a body member having a perimeter wall defining an interior space, said body member being adapted for receiving a hand of the user into said interior space of said body member through an open end of said body member;

a pocket portion being coupled to an aperture in said perimeter wall of said body member, said pocket portion being adapted for holding a bar of soap when the user is bathing, said pocket portion being positioned proximate a palm portion of said body member such that said pocket portion is adapted for positioning the bar of soap adjacent a palm of the hand for the user to apply pressure on the bar of soap when the hand of the user is positioned in said body member while bathing;

said pocket portion defining a cavity, said cavity being open to said interior space of said body member such that the bar of soap is insertable into said cavity of said pocket portion through said interior space when the hand of the user removed from said interior space;

said pocket portion including a bottom wall and a peripheral wall, the peripheral wall of said pocket portion extending substantially perpendicular to the palm portion of said body member such that said pocket portion protrudes outwardly from an outer surface of said body member;

the bottom wall of said pocket portion extending substantially perpendicular to the peripheral wall of said pocket portion, the bottom wall extending substantially parallel to the palm portion of said body member;

said pocket portion comprising a porous material, said porous material being adapted for permitting water to flow over the bar of soap when the bar of soap is positioned in the pocket portion, said porous material of said pocket portion being adapted for facilitating scrubbing and exfoliating of skin of the user;

said body member having a plurality of digit sleeves, said digit sleeves being positioned opposite said open end of said body member, each of said digit sleeves being adapted for receiving one of the digits of the hand of the user when the hand of the user is positioned in said interior space of said body member;

each of said digit sleeves having an free end positioned opposite said body member, said free end of each of said digit sleeves having an orifice for permitting a portion of a respective one of the digits to extend from said body member;

a strap being coupled to said body member adjacent said open end of said body member, said strap being adapted for extending around a wrist of the user for securing said body member to the wrist of the user when the hand of the user is positioned in said interior space of said body member;

said strap member having a first end and second end, said first end having a first fastener portion coupled to an exterior surface of said strap, said second end having a second fastener portion coupled to an interior surface of said strap, said first fastener portion being for releasably coupling to said second fastener portion such that said second end of said strap extends over said first end of said strap for adjustably setting a radius of said strap when said first end is coupled to salid second end, said strap being adapted for adjustably accommodating a variety of wrist sizes;

said first fastener portion comprises a first portion of hook and loop fastener, said second fastener portion comprises a second portion of hook and loop fastener, said first portion of hook and loop fastener being complimentary to said second portion of hook and loop fastener such that said first portion of hook and loop fastener is releasably couplable to said second portion of hook and loop fastener;

said first end and said second end of said strap being positioned adjacent a back portion of said body member such that said first end and said second end of said strap are adapted for being positioned adjacent a back of the wrist for facilitating adjusting said radius of said strap when the hand of the user is positioned in said interior space of said body member.

* * * * *